US010371340B2

(12) United States Patent
Ishiyama et al.

(10) Patent No.: US 10,371,340 B2
(45) Date of Patent: Aug. 6, 2019

(54) VEHICLE LIGHTING DEVICE AND VEHICLE LAMP

(71) Applicant: Toshiba Lighting & Technology Corporation, Yokosuka-shi, Kanagawa-ken (JP)

(72) Inventors: Masayuki Ishiyama, Yokosuka (JP); Ryuji Tsuchiya, Yokosuka (JP); Kiyokazu Hino, Yokosuka (JP); Takashi Kaneko, Yokosuka (JP); Daisuke Kosugi, Yokosuka (JP); Toshihiro Hatanaka, Yokosuka (JP); Hiromitsu Shiraishi, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 256 days.

(21) Appl. No.: 15/428,574

(22) Filed: Feb. 9, 2017

(65) Prior Publication Data

US 2017/0343180 A1 Nov. 30, 2017

(30) Foreign Application Priority Data

May 27, 2016 (JP) ..... 2016-106340

(51) Int. Cl.
*F21S 43/14* (2018.01)
*F21S 41/19* (2018.01)
(Continued)

(52) U.S. Cl.
CPC ..... *F21S 43/14* (2018.01); *F21S 41/194* (2018.01); *F21S 43/195* (2018.01); *F21S 45/47* (2018.01);
(Continued)

(58) Field of Classification Search
CPC ..... F21S 41/19; F21S 41/194; F21S 41/192; F21S 43/19; F21S 43/195; F21S 43/14;
(Continued)

(56) References Cited

U.S. PATENT DOCUMENTS 5,378,158 A * 1/1995 Owen ..... F21V 19/001 439/57
8,764,248 B1 * 7/2014 Simon ..... F21V 17/005 362/257
(Continued)

FOREIGN PATENT DOCUMENTS

EP 2345836 A2 7/2011
JP 2014-038731 A 2/2014
WO 2015/012084 A1 1/2015

*Primary Examiner* — Erin Kryukova
(74) *Attorney, Agent, or Firm* — Banner & Witcoff, Ltd.

(57) ABSTRACT

According to one embodiment, a vehicle lighting device includes a mounting portion that has a recessed portion; a plurality of bayonets that are provided on an outside surface of the mounting portion; a substrate that is provided on a bottom surface of the recessed portion; and a light emitting element that is provided on a side of the substrate opposite to a bottom surface side of the recessed portion. In a case where the vehicle lighting device is viewed from a light emitting side, at least one corner portion of the substrate overlaps with one of the plurality of bayonets.

20 Claims, 4 Drawing Sheets

(51) Int. Cl.

| | |
|---|---|
| ***F21V 19/00*** | (2006.01) |
| ***F21S 43/19*** | (2018.01) |
| ***F21S 45/47*** | (2018.01) |
| ***F21S 45/48*** | (2018.01) |
| ***F21S 43/145*** | (2018.01) |
| ***F21S 41/143*** | (2018.01) |
| ***F21Y 115/00*** | (2016.01) |
| ***F21V 23/00*** | (2015.01) |
| ***F21Y 115/10*** | (2016.01) |

(52) U.S. Cl.
CPC ..... *F21S 45/48* (2018.01); *F21V 19/003* (2013.01); *F21S 41/143* (2018.01); *F21S 43/145* (2018.01); *F21V 23/005* (2013.01); *F21Y 2115/00* (2016.08); *F21Y 2115/10* (2016.08)

(58) Field of Classification Search
CPC ..... F21S 43/145; F21S 45/47; F21S 45/48; F21V 19/001; F21V 19/0015; F21V 19/003; F21V 19/0035; F21V 19/0045; F21V 29/004; F21V 31/00; F21V 31/005; F21V 31/03; F21V 17/005; F21K 9/23; F21K 9/235; F21K 9/237; F21K 9/238; F21Y 2115/00; F21Y 2115/10
See application file for complete search history.

(56) References Cited

U.S. PATENT DOCUMENTS

2005/0041420 A1* 2/2005 Tiesler-Wittig ..... F21S 41/192 362/655
2008/0080187 A1* 4/2008 Purinton ..... F21K 9/00 362/294
2008/0117647 A1* 5/2008 Behr ..... F21V 29/004 362/547
2010/0128479 A1* 5/2010 Biebl ..... F21K 9/00 362/249.02
2011/0103081 A1* 5/2011 Thullier ..... F21S 48/1109 362/396
2011/0175529 A1 7/2011 Hayashi et al.
2011/0317438 A1* 12/2011 Erhard ..... F21K 9/00 362/382
2012/0026747 A1* 2/2012 Hayashi ..... F21V 31/04 362/520
2012/0120659 A1* 5/2012 Lopez ..... F21V 19/045 362/249.02
2012/0176798 A1* 7/2012 Becker ..... F21S 41/14 362/296.01
2012/0195053 A1* 8/2012 Wu ..... F21V 29/773 362/373
2012/0307511 A1* 12/2012 Cheng ..... F21S 41/192 362/518
2015/0016136 A1* 1/2015 Nakano ..... F21S 43/195 362/520
2015/0103552 A1* 4/2015 Aiso ..... F21S 45/48 362/549
2015/0153026 A1 6/2015 Chen
2015/0211725 A1* 7/2015 Ikuta ..... F21S 41/192 362/382
2015/0247606 A1* 9/2015 Gerlach ..... F21V 29/70 362/249.01
2016/0076754 A1* 3/2016 Creusen ..... F21V 29/505 362/84
2016/0215948 A1* 7/2016 Helbig ..... F21S 43/195
2017/0067626 A1* 3/2017 Ito ..... F21S 41/192

* cited by examiner

VEHICLE LIGHTING DEVICE AND VEHICLE LAMP

CROSS-REFERENCE TO RELATED APPLICATIONS

This application is based upon and claims the benefit of priority from Japanese Patent Application No. 2016-106340, filed on May 27, 2016; the entire contents of which are incorporated herein by reference.

FIELD

Embodiments described herein relate generally to a vehicle lighting device and a vehicle lamp.

BACKGROUND

There is a vehicle lighting device including a socket which has a mounting portion mounted on a vehicle lamp, and a substrate which is stored on an inside of the mounting portion and on which a light emitting diode, a control element, and the like are mounted.

In such a vehicle lighting device, in order to miniaturize the vehicle lighting device and to increase a substrate area, a technique, in which a corner portion of the substrate is provided on an inside of a mounting portion and is provided in the vicinity of an outside surface of the mounting portion, is suggested. In this way, it is possible to reduce the vehicle lighting device and to increase the substrate area.

Here, in recent years, an advanced function and a multi-function of the vehicle lighting device are processed. Therefore, the number and types of elements and members provided on the substrate tend to increase. If the number and types of elements and members increase, it is necessary to increase the substrate area. In this case, if an external dimension (sectional area dimension) of the mounting portion is increased, it is possible to increase the substrate area. However, if the external dimension of the mounting portion is increased, it is difficult to mount the vehicle lighting device on an existing vehicle lamp. In addition, if the external dimension of the mounting portion is increased, miniaturization of the vehicle lighting device cannot be achieved.

Therefore, development of a technique capable of further increasing the substrate area is desired.

DETAILED DESCRIPTION

Figure 1:
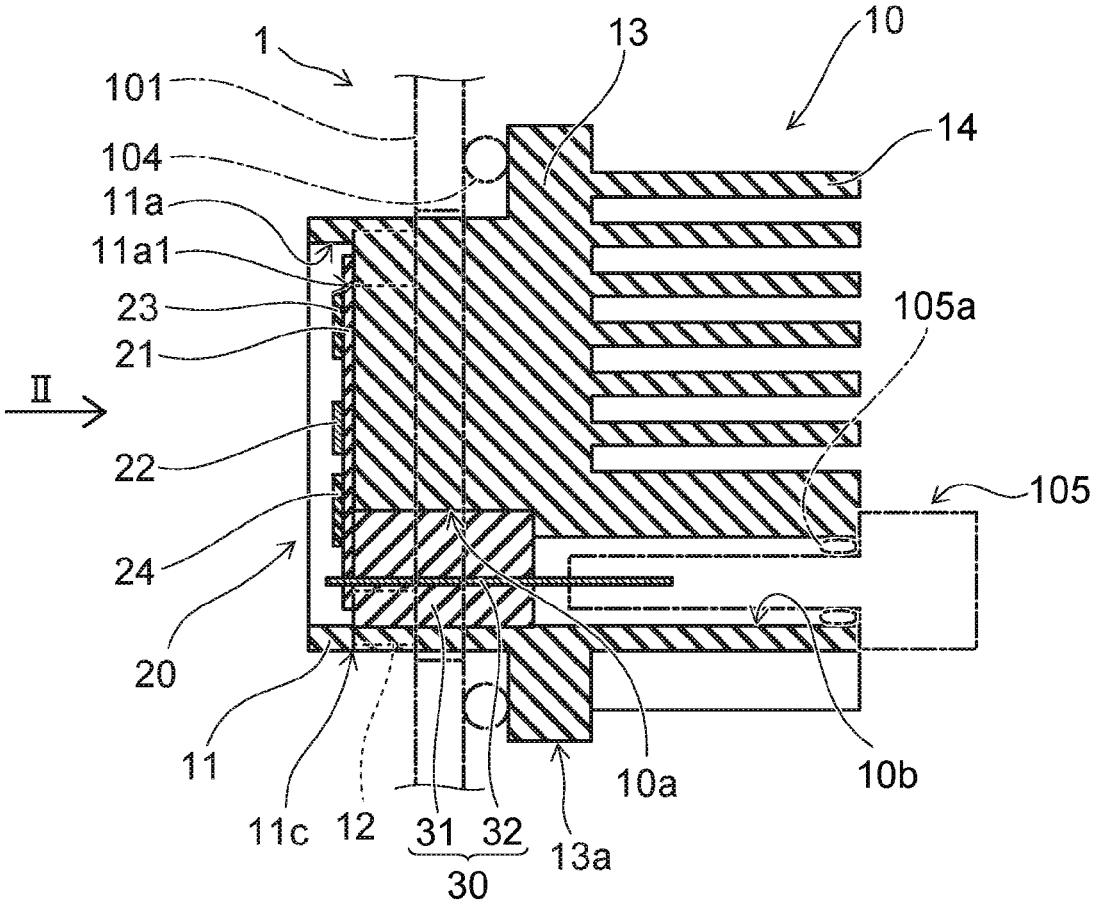
FIG. 1 is a schematic sectional view illustrating a vehicle lighting device according to an embodiment.

In general, according to one embodiment, a vehicle lighting device includes a mounting portion that has a recessed portion; a plurality of bayonets that are provided on an outside surface of the mounting portion; a substrate that is provided on a bottom surface of the recessed portion; and a light emitting element that is provided on a side of the substrate opposite to a bottom surface side of the recessed portion.

In a case where the vehicle lighting device is viewed from a light emitting side, at least one corner portion of the substrate overlaps with any one of the plurality of bayonets.

Hereinafter, exemplary embodiments will be described with reference to the drawings. Moreover, the same reference numerals are given to the same configuration elements in each drawing and detailed description will be appropriately omitted.

Vehicle Lighting Device

A vehicle lighting device 1 of the exemplary embodiment, for example, can be provided in automobiles, railway vehicles, or the like. As the vehicle lighting device 1 provided in the automobile, for example, a front combination light (formed by appropriately combining, for example, a daytime running lamp (DRL), a position lamp, a turn signal lamp, and the like), a rear combination light (formed by appropriately combining, for example, a stop lamp, a tail lamp, a turn signal lamp, a back lamp, a fog lamp, and the like), and the like can be exemplified. However, application of the vehicle lighting device 1 is not limited to the examples.

FIG. 1 is a schematic sectional view illustrating the vehicle lighting device 1 according to the embodiment.

Figure 2:
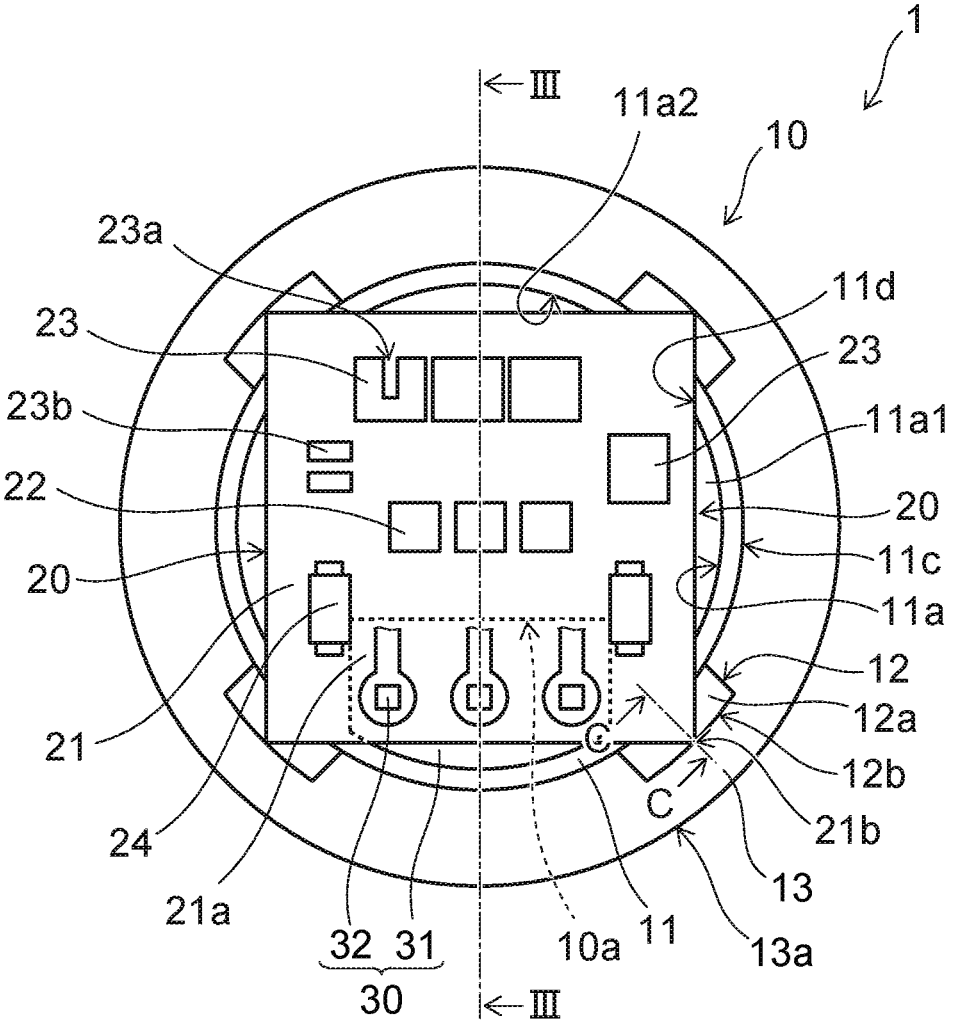
FIG. 2 is a schematic view illustrating the vehicle lighting device viewed from direction II in FIG. 1.

Moreover, FIG. 1 is a schematic sectional view of the vehicle lighting device 1 that is taken along a direction of line I-I in FIG. 2.

FIG. 2 is a schematic view illustrating the vehicle lighting device 1 viewed from direction II in FIG. 1.

That is, FIG. 2 is a schematic view of the vehicle lighting device 1 when viewed from a light emitting side.

FIGS. 3A to 3D are schematic sectional views illustrating the vehicle lighting device 1 that is taken along line III-III in FIG. 2.

As illustrated in FIGS. 1 and 2, the vehicle lighting device 1 is provided with a socket 10, a light emitting module 20, and a power supplying portion 30.

The socket 10 has a mounting portion 11, bayonets 12, a flange 13, and radiating fins 14.

The mounting portion 11 is provided on a surface of the flange 13 on a side opposite to a side on which the radiating fins 14 are provided. An external shape of the mounting portion 11 can be columnar. The external shape of the mounting portion 11 is, for example, cylindrical. The mounting portion 11 has a recessed portion 11*a* that is opened to an end surface on a side opposite to a flange 13 side. A bottom surface 11*a*1 of the recessed portion 11*a* is provided with the light emitting module 20.

The bayonets 12 are provided on an outside surface 11*c* (surface of the mounting portion 11 intersecting the end surface to which the recessed portion 11*a* is opened) of the mounting portion 11. The bayonets 12 protrude outward from the vehicle lighting device 1. The bayonets 12 face the flange 13. The bayonets 12 are provided on a bottom surface 11*a*1 side (below a substrate 21) of the recessed portion 11*a* of the substrate 21. A plurality of bayonets 12 are provided. The bayonets 12 are used when the vehicle lighting device 1 is attached to a housing 101 of a vehicle lamp 100. The bayonets 12 are used for twist lock.

The flange 13 has a plate shape. The flange 13 can have, for example, a disk shape. An outside surface 13*a* of the flange 13 is positioned on an outside of the vehicle lighting device 1 from an outside surface 12*b* of the bayonet 12.

The radiating fins 14 are provided on a surface of the flange 13 on a side opposite to a side on which the mounting portion 11 is provided. A plurality of radiating fins 14 can be provided. The plurality of radiating fins 14 are provided so as to be parallel to each other. The radiating fin 14 can have a plate shape.

In addition, the socket 10 is provided with a hole 10*a* into which an insulating portion 31 is inserted and a hole 10*b* into which a connector 105 is inserted.

The connector 105 having a sealing member 105*a* is inserted into the hole 10*b*. Therefore, a cross section shape of the hole 10*b* is fitted to a cross section shape of the connector 105 having the sealing member 105*a*.

Therefore, heat generated in the light emitting module 20 is mainly transmitted to the radiating fins 14 via the mounting portion 11 and the flange 13. Heat transmitted to the radiating fins 14 is discharged from the radiating fins 14 to the outside.

Therefore, it is preferable that the socket 10 is formed of a material having high thermal conductivity considering that heat generated in the light emitting module 20 is transmitted to the outside. The material having high thermal conductivity can be, for example, metal, resin having high thermal conductivity, or the like. Resin having high thermal conductivity is obtained, for example, by mixing a filler made of aluminum oxide having high thermal conductivity to resin such as ployethylene terephthalate (PET) and nylon. In addition, if the socket 10 is formed using resin having high thermal conductivity, it is possible to efficiently radiate heat generated in the light emitting module 20 and to achieve a light weight thereof.

The light emitting module 20 has the substrate 21, a light emitting element 22, resistors 23, and a control element 24.

The substrate 21 is provided in the bottom surface 11*a*1 of the recessed portion 11*a*. The substrate 21 has a plate shape. The planar shape of the substrate 21 can be, for example, a rectangle.

A material or a structure of the substrate 21 is not particularly limited. For example, the substrate 21 can be formed of an inorganic material such as ceramics (for example, aluminum oxide, aluminum nitride, and the like), an organic material such as paper phenol and glass epoxy, and the like. In addition, the substrate 21 may be obtained by coating a surface of a metal plate with an insulating material. Moreover, in a case where the surface of the metal plate is coated with the insulating material, the insulating material may be formed of an organic material or may be formed of an inorganic material.

In a case where a heating value of the light emitting element 22 is large, it is preferable that the substrate 21 is formed by using a material having high thermal conductivity in terms of heat radiation. As the material having high thermal conductivity, ceramics such as aluminum oxide or aluminum nitride, resin having high thermal conductivity, a material that is obtained by coating a surface of a metal plate with an insulating material, and the like can be exemplified.

In addition, the substrate 21 may be a single layer or may be a multi-layer.

A wiring pattern 21*a* is provided on the surface of the substrate 21.

The wiring pattern 21*a* can be formed of a material containing silver as a main component. The wiring pattern 21*a* can be formed of, for example, silver or a silver alloy. However, a material of the wiring pattern 21*a* is not limited to a material containing silver as a main component. The wiring pattern 21*a* can be formed of, for example, a material containing copper as a main component.

The light emitting element 22 is provided on a substrate 21 side opposite to a bottom surface 11*a*1 side of the recessed portion 11*a*. The light emitting element 22 is provided on the substrate 21. The light emitting element 22 is electrically connected to the wiring pattern 21*a* provided on the surface of the substrate 21. The light emitting element 22 can be, for example, a light emitting diode, an organic light emitting diode, a laser diode, and the like.

A plurality of light emitting elements 22 can be provided. The plurality of light emitting elements 22 can be connected in series with each other.

In addition, the light emitting elements 22 are connected in series with the resistors 23.

A form of the light emitting element 22 is not particularly limited.

The light emitting element 22 can be a light emitting element of a surface mounting type such as Plastic Leaded Chip Carrier (PLCC) type.

The light emitting element 22 can be, for example, a light emitting element having a lead wire of a shell type and the like.

In addition, the light emitting element 22 can be mounted by Chip On Board (COB). In a case of the light emitting element 22 that is mounted by the COB, it is possible to provide the light emitting element 22 of a chip shape, wiring electrically connecting the light emitting element 22 and the wiring pattern 21*a*, a frame-like member surrounding the light emitting element 22 and the wiring, a sealing portion provided on an inside of the frame-like member, and the like on the substrate 21.

In this case, the sealing portion can include a phosphor. The phosphor can be, for example, a YAG-based phosphor (yttrium-aluminum-garnet based fluorescent material).

For example, if the light emitting element 22 is a blue light emitting diode and the phosphor is the YAG-based phosphor, the YAG-based phosphor is excited by blue light emitted from the light emitting element 22 and yellow fluorescence is emitted from the YAG-based phosphor. Then, white light is emitted from the vehicle lighting device 1 by mixing blue light and yellow light. Moreover, types of the phosphors and types of the light emitting elements 22 are not limited to the examples described above. The types of the phosphors and the types of the light emitting elements 22 can be appropriately changed such that a desired emitting color is obtained in accordance with the application of the vehicle lighting device 1 and the like.

Moreover, the light emitting element 22 illustrated in FIGS. 1 and 2 is the light emitting element of the surface mounting type.

The upper surface of the light emitting element 22 that is an emitting surface of light faces a front side of the vehicle lighting device 1 and mainly emits light on the front side of the vehicle lighting device 1.

The number, sizes, and arrangements of the light emitting elements 22, and the like are not limited to the examples described above, and can be appropriately changed in accordance with the size and the application of the vehicle lighting device 1, and the like.

The resistors 23 are provided on the substrate 21 side opposite to the bottom surface 11*a*1 side of the recessed portion 11*a*. The resistors 23 are provided on the substrate 21. The resistors 23 are electrically connected to the wiring pattern 21*a* disposed on the surface of the substrate 21.

The resistors 23 can be, for example, resistors of a surface mounting type, resistors (metal oxide film resistor) having a lead wire, film-like resistors formed using a screen printing method, and the like.

Moreover, the resistors 23 illustrated in FIGS. 1 and 2 are the resistors of the surface mounting type.

A material of the film-like resistor can be, for example, ruthenium oxide ($RuO_2$). The film-like resistor can be formed by using a screen printing method and a firing method. If the resistor 23 is the film-like resistor, it is possible to increase a contact area between the resistor 23 and the substrate 21. Therefore, it is possible to improve heat radiation property. In addition, a plurality of resistors 23 can be formed all at once. Therefore, it is possible to improve the productivity and it is possible to suppress variation in resistance values in the plurality of resistors 23.

Since there are variations in forward voltage characteristics of the light emitting element 22, if an applied voltage between an anode terminal and a ground terminal is constant, variations occur in brightness (luminous flux, luminance, luminous intensity, and illuminance) of the light emitting element 22. Therefore, a value of a current flowing through the light emitting element 22 is made to fall within a predetermined range by the resistors 23 so that the brightness of the light emitting element 22 falls within a predetermined range. In this case, a value of the current flowing through the light emitting element 22 can be within a predetermined range by changing resistance values of the resistors 23.

In a case where the resistors 23 are resistors of a surface mounting type, resistors having a lead wire, the resistors 23 having an appropriate resistance value according to the forward voltage characteristics of the light emitting element 22 are selected.

In a case where the resistor 23 is the film-like resistor, a part of the resistor 23 forms a removed portion 23*a* that is formed by removing a part of the resistor 23. Then, the resistance value of the resistor 23 is changed by a size of the removed portion 23*a* or the like. In this case, if the removed portion 23*a* is formed, the resistance value increases. For example, if the resistor 23 is irradiated with laser light, the removed portion 23*a* can be easily formed.

The number, sizes, and arrangements of the resistors 23 and the removed portions 23*a*, and the like are not limited to the examples described above, and can be appropriately changed in accordance with the number and the application of the light emitting elements 22, and the like.

The control element 24 is provided on a side of the substrate 21 opposite to the bottom surface 11*a*1 side of the recessed portion 11*a*. The control element 24 is provided on the substrate 21. The control element 24 is electrically connected to the wiring pattern 21*a* provided on the surface of the substrate 21. The control element 24 is provided so that a reverse voltage is not applied to the light emitting element 22 and pulse noise from a reverse direction is not applied to the light emitting element 22.

The control element 24 can be, for example, a diode. The control element 24 can be, for example, a diode of a surface mounting type, a diode having a lead wire, or the like. The control element 24 illustrated in FIGS. 1 and 2 is the diode of the surface mounting type.

In addition, it is also possible to provide a pull-down resistor 23*b* to detect disconnection of the light emitting element 22, to prevent erroneous lighting, and the like. In addition, it is also possible to provide a cover portion (not illustrated) for covering the wiring pattern, the film-like resistor, and the like. The cover portion can include, for example, a glass material.

The power supplying portion 30 has an insulating portion 31 and power supply terminals 32.

The insulating portion 31 is provided on an inside of the hole 10*a*. The insulating portion 31 can be pressed into the hole 10*a*, or can be mounted on the inside of the hole 10*a*. In addition, the insulating portion 31 can be integrally formed with the socket 10.

The insulating portion 31 is formed of an insulating material. In this case, considering that heat generated in the light emitting module 20 is transmitted to the radiating fins 14, it is preferable that the insulating portion 31 is formed of a material having insulating properties and high thermal conductivity. The material having insulating properties and high thermal conductivity can be, for example, ceramics (for example, aluminum oxide, aluminum nitride, or the like), high thermal conductivity resin, or the like.

In addition, in a case of the vehicle lighting device 1 provided in the automobile, a temperature of environment of use is −40° C. to 85° C. Therefore, it is preferable that a thermal expansion coefficient of the material of the insulating portion 31 is as close as possible to the thermal expansion coefficient of the material of the socket 10. In this way, thermal stress generated between the insulating portion 31 and the socket 10 can be reduced. For example, the material of the insulating portion 31 can be the high thermal conductivity resin contained in the socket 10, or can be resin contained in the high thermal conductivity resin.

A plurality of power supply terminals 32 are provided. The plurality of power supply terminals 32 are provided on the inside of the insulating portion 31. The plurality of power supply terminals 32 extend inside the insulating portion 31. One end portion of each of the plurality of power supply terminals 32 is electrically connected to the light emitting module 20. The other end portion of each of the plurality of power supply terminals 32 protrudes from the insulating portion 31. Moreover, the number and the shape of the power supply terminals 32, and the like are not limited to the examples and can be appropriately changed.

Here, in recent years, an advanced function and a multi-function of the vehicle lighting device 1 are processed. Therefore, the number and types of the light emitting elements 22, the resistors 23, and the control elements 24, and the like provided on the substrate 21 tend to increase. In addition, in a case of the light emitting element 22 that is mounted by the COB, a frame-like member surrounding the light emitting element 22 and the wiring, a sealing portion provided on an inside of the frame-like member, and the like are further provided.

If the number and the types of elements or members provided in the substrate 21, and the like increase, it is necessary to increase an area of the substrate.

In this case, if an external dimension (sectional area dimension) of the mounting portion 11 increases, the area of the substrate can be increased. However, when mounting the vehicle lighting device 1 on the vehicle lamp 100, the mounting portion 11 is inserted into an attachment hole 101*a* of the housing 101 (see FIG. 4). Therefore, if the external dimension of the mounting portion 11 is increased, it is difficult to attach the vehicle lighting device 1 to the existing vehicle lamp 100. In addition, if the external dimension of the mounting portion 11 is increased, miniaturization of the vehicle lighting device 1 cannot be achieved.

Furthermore, if the substrate 21 protrudes outward from the outside surface 11*c* of the mounting portion 11, there is a concern that the mounting portion 11 cannot be inserted into the attachment hole 101*a* of the housing 101. Therefore, in general, the substrate 21 is provided on the inside from the outside surface 11*c* of the mounting portion 11. As a result, it is difficult to increase the area of the substrate.

Therefore, in the vehicle lighting device 1 according to the embodiment, in a case where the vehicle lighting device 1 is viewed from a light emitting side (in a case where the vehicle lighting device 1 is viewed from the direction II in FIG. 1), at least one corner portion 21*b* of the substrate 21 overlaps with any one of the plurality of bayonets 12. Moreover, in a case of the vehicle lighting device 1 illustrated in FIG. 2, all the corner portions 21*b* of the substrate 21 overlap with the bayonets 12.

At least one corner portion 21*b* of the substrate 21 is provided on the outside of the outside surface 11*c* of the mounting portion 11.

In a case where the vehicle lighting device 1 is viewed from the light emitting side, a portion of the substrate 21 provided on the outside of the outside surface 11*c* of the mounting portion 11 is provided on an inside from a periphery of the bayonet 12. That is, in a case where the vehicle lighting device 1 is viewed from the light emitting side, the substrate 21 does not protrude from the bayonets 12.

In a case where the vehicle lighting device 1 is viewed from the light emitting side, the corner portions 21*b* of the substrate 21 are provided between the outside surface 12*b* of the bayonet 12 and the outside surface 11*c* of the mounting portion 11. Moreover, in a case of the vehicle lighting device 1 illustrated in FIG. 2, the corner portion 21*b* of the substrate 21 is provided at a position of the outside surface 12*b* of the bayonet 12.

Figure 3A:
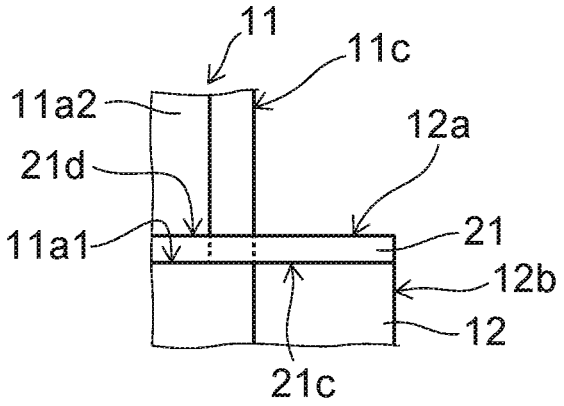
FIGS. 3A to 3D are schematic sectional views illustrating the vehicle lighting device that is taken along line III-III in FIG. 2.

As illustrated in FIG. 3A, a surface 21*c* of the substrate 21 on a side opposite to a side on which the light emitting element 22 is provided can be provided on an upper surface 12*a* of the bayonet 12.

Figure 3B:
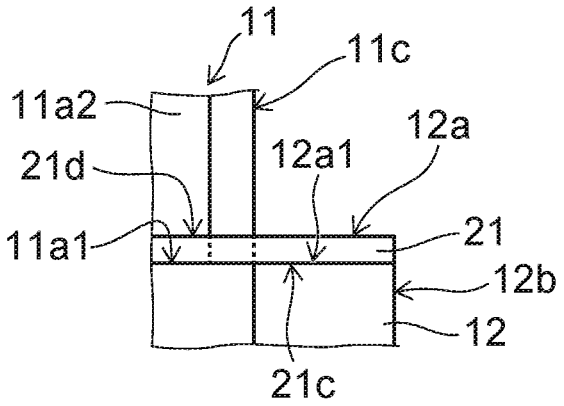
Figure 3C:
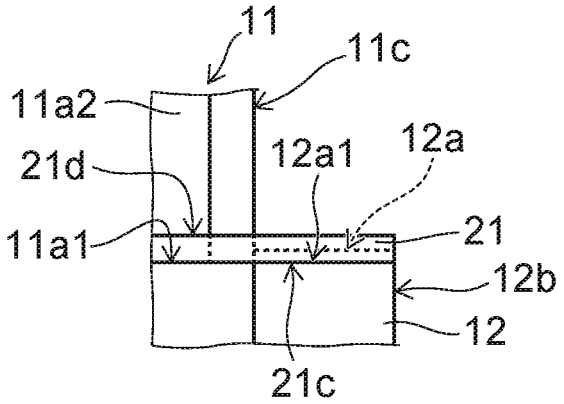
Figure 3D:
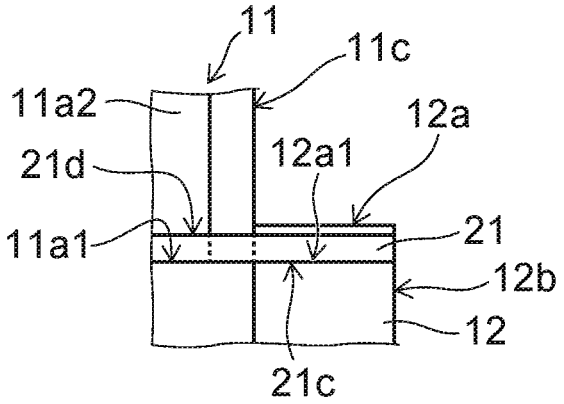

In addition, as illustrated in FIGS. 3B, 3C, and 3D, the surface 21*c* of the substrate 21 can be provided on the bottom surface 11*a*1 of the recessed portion opened to the upper surface 12*a* of the bayonet 12.

In this case, as illustrated in FIG. 3B, a surface 21*d* of the substrate 21 on the side on which the light emitting element 22 is provided can be flush with the upper surface 12*a* of the bayonet 12.

In addition, as illustrated in FIG. 3C, the surface 21*d* of the substrate 21 can also be located on a side opposite to the flange 13 side from the upper surface 12*a* of the bayonet 12. That is, the surface of the substrate 21 on the bottom surface 11*a*1 side of the recessed portion 11*a* can be provided above the upper surface 12*a* of the bayonet 12.

In addition, as illustrated in FIG. 3D, the surface 21*d* of the substrate 21 can be provided on the flange 13 side from the upper surface 12*a* of the bayonet 12. That is, the surface of the substrate 21 on the bottom surface 11*a*1 side of the recessed portion 11*a* can be provided below the upper surface 12*a* of the bayonet 12.

Moreover, in order to increase the radiation properties, a metal substrate, thermal conductivity grease, a layer formed of adhesive (not illustrated), or the like can be interposed between the surface 21*c* on the substrate 21 side opposite to the side on which the light emitting element 22 is provided and the bottom surface 11*a*1 of the recessed portion 11*a* of the mounting portion 11.

Thermal conductivity grease, a layer formed of adhesive, or the like can be provided between the surface 21*c* of the substrate 21 on the side opposite to the side on which the light emitting element 22 is provided and the bayonet 12.

As described below, a recessed portion into which the bayonet 12 is inserted is provided in the periphery of the attachment hole 101*a* of the housing 101 provided in the vehicle lamp 100. Therefore, even if the substrate 21 protrudes outward from the outside surface 11*c* of the mounting portion 11, the mounting portion 11 can be inserted into the attachment hole 101*a* of the housing 101 if it is above the bayonet 12.

The mounting portion 11 is provided with a slit 11*d*. The slit 11*d* penetrates between a side surface 11*a*2 of the recessed portion 11*a* and the outside surface 11*c* of the mounting portion 11. The slit 11*d* extends between an end surface of the mounting portion 11 on the side opposite to the flange 13 side and an end surface of the bayonet 12 on the side opposite to the flange 13 side. The slit 11*d* is provided above the bayonet 12. That is, in a case where the vehicle lighting device 1 is viewed from the light emitting side, the slit 11*d* is provided at a position at which the bayonet 12 is provided in a circumferential direction of the mounting portion 11.

The vicinity of at least one corner portion 21*b* of the substrate 21 is provided on an inside of the slit 11*d*. In this case, the substrate 21 and a wall surface of the slit 11*d* may be in contact with each other, or may have a gap.

Figure 4:
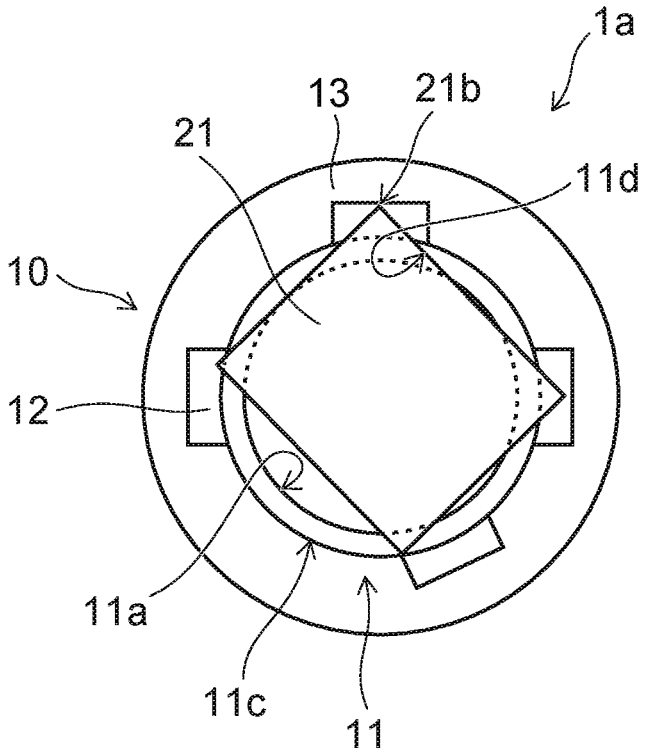
FIG. 4 is a schematic view illustrating a vehicle lighting device according to another embodiment.

FIG. 4 is a schematic view illustrating a vehicle lighting device 1*a* according to another embodiment.

Moreover, FIG. 4 is a schematic view in a case where the vehicle lighting device 1*a* is viewed from a light emitting side.

In addition, in FIG. 4, in order to avoid complication, only a mounting portion 11, a bayonet 12, a flange 13, and a substrate 21 are drawn.

In the vehicle lighting device 1 illustrated in FIG. 2, all the corner portions 21*b* of the substrate 21 are provided on the outside of the outside surface 11*c* of the mounting portion 11.

In contrast, in the vehicle lighting device 1*a* illustrated in FIG. 4, a part of corner portions 21*b* of the substrate 21 is provided on an outside of an outside surface 11*c* of the mounting portion 11.

That is, at least one corner portion 21*b* of the substrate 21 may be provided on the outside of the outside surface 11*c* of the mounting portion 11. If at least one corner portion 21*b* of the substrate 21 is provided on the outside of the outside surface 11*c* of the mounting portion 11, it is possible to increase an area of the substrate. However, if the number of the corner portions 21*b* of the substrate 21 provided on the outside of the outside surface 11*c* of the mounting portion 11 is increased, it is possible to further increase the area of the substrate.

In addition, in the vehicle lighting device 1 illustrated in FIG. 2, the plurality of bayonets 12 are provided at the positions point symmetrical with respect to the center of the mounting portion 11.

In contrast, the vehicle lighting device 1*a* illustrated in FIG. 4, a plurality of bayonets 12 are provided at arbitrary positions.

Therefore, the positions of the bayonets 12 may not match the positions of the corner portions 21*b* of the substrate 21. However, if even one of the positions of the bayonets 12 matches one of the positions of the corner portions 21*b* of the substrate 21, it is possible to increase the area of the substrate. However, if the number of the positions of the bayonets 12 matching the positions of the corner portions 21*b* of the substrate 21 is increased, it is possible to increase the area of the substrate.

Moreover, in a case where the positions of the bayonets 12 do not match the positions of the corner portions 21*b* of the substrate 21, the corner portion 21*b* of the substrate 21 is provided on the inside from the outside surface 11*c* of the mounting portion 11.

In addition, in the vehicle lighting device 1 illustrated in FIG. 2, the planar shape of the substrate 21 is a square.

In contrast, in the vehicle lighting device 1*a* illustrated in FIG. 4, a planar shape of the substrate 21 is a rectangle.

In this case, the planar shape of the substrate 21 can also be an arbitrary shape. However, the planar shape of the substrate 21 is quadrangular, the number of the substrates 21, which can be manufactured from a planar material having a predetermined external dimension, can be increased.

In addition, in FIGS. 2 and 4, a case where four bayonets 12 are provided is illustrated, but the number of the bayonets 12 may be two or more. In this case, if the number of the bayonets 12 is three or more, postures of the vehicle lighting devices 1 and 1*a* are stabilized. Moreover, it is preferable that the number of the bayonets 12 is equal to the number of the corner portions 21*b* of the substrate 21 or is greater than that thereof.

As described above, according to the vehicle lighting devices 1 and 1*a*, it is possible to increase the area of the substrate. If the size of the substrate 21 can be increased, the number and the types of elements, members, and the like provided in the substrate 21 are easily increased. Therefore, the advanced function and the multi-function of the vehicle lighting device 1 can be performed.

In this case, if the number of the light emitting elements 22, the resistors 23, and the control elements 24 provided in the substrate 21, and the like is increased, a heating value is also increased. However, if the size of the substrate 21 can be increased, it is possible to improve the radiation properties. In addition, the bayonets 12 are in contact with the vehicle lamp 100. Therefore, heat generated in the light emitting module 20 can escape to the vehicle lamp 100 via the vicinity of the corner portions 21*b* of the substrate 21 and the bayonets 12.

Therefore, even in a case where the number of the light emitting elements 22, the resistors 23, and the control elements 24 is increased, it is possible to suppress an increase in a temperature of the light emitting element 22.

In addition, since the slit 11*d* is provided, external air is easily introduced into the inside of the recessed portion 11*a*. Therefore, it is possible to further effectively suppress the increase in the temperature of the light emitting element 22.

In addition, since it is unnecessary to change the external dimension of the mounting portion 11, it is possible to mount the vehicle lighting device 1 on the existing vehicle lamp 100. In addition, the miniaturization of the vehicle lighting device 1 can be achieved.

Vehicle Lamp

Next, the vehicle lamp 100 will be described.

Moreover, hereinafter, as an example, a case where the vehicle lamp 100 is a front combination light provided in the automobile will be described. However, the vehicle lamp 100 is not limited to the front combination light provided in the automobile. The vehicle lamp 100 may be a vehicle lamp provided in an automobile, a railway vehicle, and the like.

Figure 5:
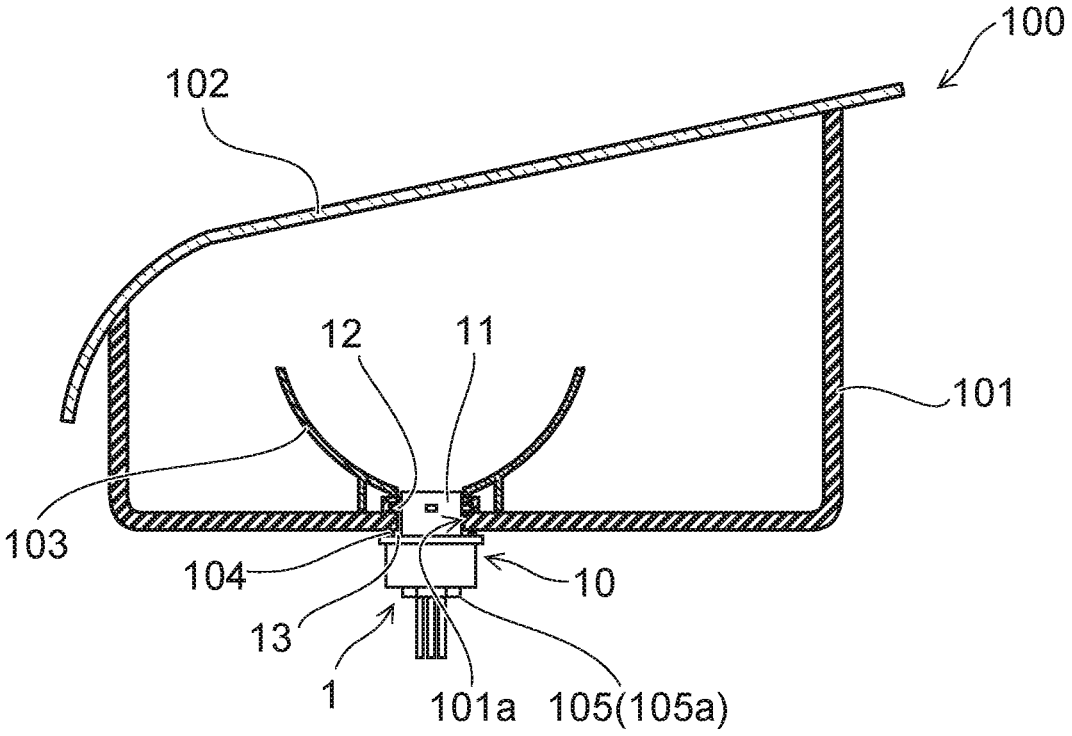
FIG. 5 is a partial sectional view schematically illustrating a vehicle lamp.

FIG. 5 is a partial sectional view schematically illustrating the vehicle lamp 100.

As illustrated in FIG. 5, the vehicle lighting device 1, the housing 101, a cover 102, an optical element portion 103, a sealing member 104, and the connector 105 are provided in the vehicle lamp 100.

The housing 101 holds the mounting portion 11. The housing 101 has a box shape of which one end portion is opened. The housing 101 can be formed of, for example, resin and the like through which light is not transmitted. The attachment hole 101*a* into which a portion of the mounting portion 11 in which the bayonets 12 are provided is inserted is provided in a bottom surface of the housing 101. Recessed portions into which the bayonets 12 provided in the mounting portion 11 are inserted are provided in a periphery of the attachment hole 101*a*. Moreover, a case where the attachment hole 101*a* is directly provided in the housing 101 is exemplified, but an attaching member having the attachment hole 101*a* may be provided in the housing 101.

When attaching the vehicle lighting device 1 to the vehicle lamp 100, portions of the mounting portion 11 in which the bayonets 12 are provided are inserted into the attachment holes 101*a* and the vehicle lighting device 1 is rotated. Then, the bayonets 12 are held by fitting portions provided on a periphery of the attachment hole 101*a*. Such an attaching method is called a twist-lock.

The cover 102 is provided so as to close an opening of the housing 101. The cover 102 can be formed of resin and the like having a light-transmitting property. The cover 102 can have functions of a lens and the like.

Light emitted from the vehicle lighting device 1 is incident on the optical element portion 103. The optical element portion 103 performs reflection, diffusion, guiding, and condensing of the light emitted from the vehicle lighting device 1, formation of a predetermined light distribution pattern, and the like.

For example, the optical element portion 103 illustrated in FIG. 5 is a reflector. In this case, the optical element portion 103 reflects the light emitted from the vehicle lighting device 1, and causes the predetermined light distribution pattern to be formed.

The sealing member 104 is provided between the flange 13 and the housing 101. The sealing member 104 can have an annular shape. The sealing member 104 can be formed of a material having elasticity such as rubber or silicone resin.

When attaching the vehicle lighting device 1 to the vehicle lamp 100, the sealing member 104 is interposed between the flange 13 and the housing 101. Thus, an inside space of the housing 101 is closed by the sealing member 104. In addition, the bayonets 12 are pressed against the housing 101 by an elastic force of the sealing member 104. Thus, the vehicle lighting device 1 can be prevented from being separated from the housing 101.

The connectors 105 are fitted into end portions of the plurality of power supply terminals 32 exposed on the inside of the hole 10*b*. Power supply (not illustrated) and the like are electrically connected to the connectors 105. Therefore, power supply (not illustrated) and the like are electrically connected to the light emitting elements 22 by fitting the connectors 105 into the end portions of the power supply terminals 32.

In addition, the connectors 105 have stepped portions. Then, the sealing member 105*a* is attached to the stepped portions (see FIG. 1). The sealing member 105*a* is provided to prevent entrance of water on the inside of the hole 10*b*. When the connector 105 having the sealing member 105*a* is inserted into the hole 10*b*, the hole 10*b* is sealed to be water tightness.

The sealing member 105*a* can have an annular shape. The sealing member 105*a* can be formed of a material having elasticity such as rubber or silicone resin. The connector 105 can also be joined, for example, to an element on the socket 10 side using adhesive or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle lighting device comprising:

a mounting portion that has a recessed portion;

a plurality of bayonets that are provided on an outside surface of the mounting portion for attaching the vehicle lighting device with a housing of a vehicle lamp;

a substrate that is provided on a bottom surface of the recessed portion; and a light emitting element that is provided on a side of the substrate opposite to a bottom surface side of the recessed portion, in a case where the vehicle lighting device is viewed from a light emitting side, each of a plurality of aligned corner portion of the substrate overlaps one of the plurality of bayonets, and at least a part of each of the plurality of aligned corner portions of the substrate is provided on an outside of the outside surface of the mounting portion.

2. The device according to claim 1, wherein the mounting portion has at least one slit penetrating between a side surface of the recessed portion and the outside surface of the mounting portion, and a vicinity of each of the plurality of aligned corner portions of the substrate is provided on an inside of a slit.

3. The device according to claim 1, wherein the plurality of bayonets are provided on the bottom surface side of the recessed portion.

4. The device according to claim 1, wherein a planar shape of the substrate is a rectangle.

5. The device according to claim 1, wherein each of the plurality of aligned corner portions portion of the substrate is provided on the outside of the outside surface of the mounting portion.

6. The device according to claim 1, wherein in a case where the vehicle lighting device is viewed from the light emitting side, a portion of the substrate provided on the outside of the outside surface of the mounting portion is provided on an inside from a periphery of the plurality of the bayonets.

7. The device according to claim 1, wherein in a case where the vehicle lighting device is viewed from the light emitting side, a portion of the substrate provided on the outside of the outside surface of the mounting portion does not protrude from the plurality of the bayonets.

8. The device according to claim 1, wherein in a case where the vehicle lighting device is viewed from the light emitting side, each of the plurality of aligned corner portions of the substrate is provided between an outside surface of a bayonet of the plurality of bayonets and the outside surface of the mounting portion.

9. The device according to claim 1, wherein in a case where the vehicle lighting device is viewed from the light emitting side, each of the plurality of aligned corner portions of the substrate is provided at a position on an outside surface of a bayonet of the plurality of bayonets.

10. The device according to claim 1, wherein a surface of the substrate on the bottom surface side of the recessed portion is provided on an upper surface of a bayonet of the plurality of bayonets.

11. The device according to claim 1, wherein a surface of the substrate on the bottom surface side of the recessed portion is provided on a bottom surface of the recessed portion opened to an upper surface of a bayonet of the plurality of bayonets.

12. The device according to claim 1, wherein a surface of the substrate on the bottom surface side of the recessed portion is provided above an upper surface of a bayonet of the plurality of bayonets.

13. The device according to claim 1, wherein a surface of the substrate on the bottom surface side of the recessed portion is provided below a position of an upper surface of a bayonet of the plurality of bayonets.

14. The device according to claim 2, wherein the slit is provided above a bayonet of the plurality of bayonets.

15. The device according to claim 2, wherein in a case where the vehicle lighting device is viewed from the light emitting side, the slit is provided at a position in which a bayonet of the plurality of bayonets is provided in a circumferential direction of the mounting portion.

16. The device according to claim 1, wherein the plurality of bayonets are provided at positions point symmetrical with respect to a center of the mounting portion.

17. The device according to claim 1, wherein each of the plurality of aligned portions of the substrate is provided on the outside of the outside surface of the mounting portion.

18. A vehicle lamp comprising:

the vehicle lighting device according to claim 1; and a housing to which the vehicle lighting device is attached.

19. The device according to claim 1, wherein the substrate has four corner portions, each of three of the four corner portions being the aligned corner portions and overlapping one of the plurality of bayonets.

20. The device according to claim 1, wherein the substrate has four corner portions, each of the four corner portions being aligned corner portions and overlapping one of the plurality of bayonets.

* * * * *